US008893326B2

(12) United States Patent
Gooris

(10) Patent No.: US 8,893,326 B2
(45) Date of Patent: Nov. 25, 2014

(54) FRAME SUPPORTED BY LAMINAE OF LESSENED FLEXIBILITY SUITABLE FOR USE IN CRADLES FOR SMALL CHILDREN

(75) Inventor: Frederic Frans Petrus Gooris, Hong Kong SAR (CN)

(73) Assignee: Bombol Limited, Kwai Chung, New Territories (HK)

( * ) Notice: Subject to any disclaimer, the term of this patent is extended or adjusted under 35 U.S.C. 154(b) by 479 days.

(21) Appl. No.: 13/498,423

(22) PCT Filed: Dec. 9, 2009

(86) PCT No.: PCT/IT2009/000554
§ 371 (c)(1),
(2), (4) Date: Mar. 27, 2012

(87) PCT Pub. No.: WO2011/051987
PCT Pub. Date: May 5, 2011

(65) Prior Publication Data

US 2012/0180212 A1 Jul. 19, 2012

(30) Foreign Application Priority Data

Oct. 27, 2009 (IT) ..... MI09A1861

(51) Int. Cl.
*A47D 9/00* (2006.01)
*A47D 1/00* (2006.01)
*A47D 13/10* (2006.01)

(52) U.S. Cl.
CPC ..... *A47D 13/107* (2013.01)
USPC ..... 5/101; 5/104; 5/655; 297/250.1; 297/294; 297/452.1; 297/452.13

(58) Field of Classification Search
USPC ..... 5/101, 103, 104, 655, 652; 297/250.1, 297/285, 294, 296, 452.1, 452.11, 452.12, 297/452.13; D6/344, 333
See application file for complete search history.

(56) References Cited

U.S. PATENT DOCUMENTS 2,283,755 A 5/1942 Mies
2,460,308 A * 2/1949 Pribil ..... 4/572.1

(Continued)

FOREIGN PATENT DOCUMENTS

CN 2548495 Y 5/2003

OTHER PUBLICATIONS

International Search Report dated Jul. 27, 2010, corresponding to PCT/IT2009/000554.

(Continued)

*Primary Examiner* — Robert G Santos
(74) *Attorney, Agent, or Firm* — Ella Cheong Hong Kong; Sam T. Yip

(57) ABSTRACT

A frame suitable for use in a cradle for small children, or in similar devices, where a structure for containing a dynamic load requires support, consists of two flexible longitudinal laminae, parallel one to another and joined by one or more crosswise laminae. The longitudinal laminae are curved in a more or less central part of their length so forming a first section that rests on the ground and a second section inclined at an angle determined in relation to the first section to sustain the containing structure. In the curved part and along the whole of the second section the longitudinal laminae are subjected to torsion opposite in sign such as to incline them towards the inside of the frame; this lessens their flexibility sufficiently to limit elongation of the flexor oscillations.

10 Claims, 7 Drawing Sheets

(56) References Cited

U.S. PATENT DOCUMENTS

| | | | | | |
|---|---|---|---|---|---|
| 2,521,422 | A | | 9/1950 | Strand, Jr. | |
| 3,110,519 | A | | 11/1963 | Chernivsky | |
| 3,235,306 | A | * | 2/1966 | Chernivsky | 297/296 |
| 4,674,795 | A | * | 6/1987 | Nelson | 297/239 |
| 5,203,611 | A | * | 4/1993 | Greenwood | 297/440.11 |
| 5,360,258 | A | | 11/1994 | Alivizatos | |
| 6,378,940 | B1 | * | 4/2002 | Longoria et al. | 297/217.3 |
| 2012/0180212 | A1 | * | 7/2012 | Gooris | 5/101 |
| 2012/0181830 | A1 | * | 7/2012 | Gooris | 297/250.1 |

OTHER PUBLICATIONS

Office Action issued from the State Intellectual Property Office of the P.R.C dated Oct. 28, 2013.

* cited by examiner

KNOWN ART

FRAME SUPPORTED BY LAMINAE OF LESSENED FLEXIBILITY SUITABLE FOR USE IN CRADLES FOR SMALL CHILDREN

FIELD OF APPLICATION OF THE INVENTION

The present invention concerns accessories for infants and, in particular, a frame supported by laminae of lessened flexibility suitable for use with cradles for small children. Although these cradles represent the main purpose of the invention, the same operative principle can be applied to the production of frames for high chairs, stools and the like. Further uses could be found in the field of industry wherever heavier dynamic loads require support.

REVIEW OF THE KNOWN ART

Parents, grandparents and anyone who looks after small children know how important it is to be able to lay the child down on a securely based but, at the same time, comfortable structure. Some sort of cradle, for example, may answer the purpose because the suitably padded back and seat make it similar to a cot, while the leg separator and the various straps provided to hold the child in place ensure sufficient safety to prevent it from falling out following some sudden movement. The child's comfort is still further increased if the rocking movement can in some degree be favoured by the structure supporting the cradle. Generally speaking, the most popular of these devices are those that facilitate the child's spontaneous movements so that it does not feel as if it were resting on a rigid surface. The sensation of rigidity is to some extent mitigated by the padded backrest and seat which, however, cannot provide the feeling given by a dynamic supporting structure. At present available on the market there are: (a) cradles with a tubular frame where the necessary protection is provided by a padded structure; (b) cradles like that illustrated in FIG. 1 supported by rockers and with a great deal of padding; (c) cradles whose frames have additional supporting shock-absorbers; (d) cradles the structure of which is in itself a shock-absorber so that there is no need for extra padding on the structure made of cloth and specially shaped for the purpose.

Solutions such as types (a) and (c) need not be discussed as they have nothing to do with the invention. Though not particularly pertinent, type (b) deserves a few words of presentation. Type (d) cradles are those most similar to the present invention which, however, intends to overcome its defects and these will be discussed with reference to the models designed and put on sale by the applicant. FIG. 1 shows a perspective view of a rocking cradle 1 formed of a wooden base 2 of a shape similar to a flat frame and curved slightly upward both on the front and at the rear so as to form a sort of rocker for a well-padded seat 3 held in an upwardly inclined position by two pairs, 4 and 5, of oblique side legs joined together, two by two, and at four points on the balancing base 2 able to favour the movements of the child. To manufacture the base a wide flat plate, of wood in this case, has to be moderately bent, but is in any case rigid and unable to serve as a shock-absorber, a function therefore fulfilled by the considerable amount of padding.

FIG. 2 gives a perspective view of a rocking cradle 10 of type (d) consisting of a frame 11 with two parallel laminae, 11 and 12, varyingly curved to allow the cradle to stand on the floor and to have a structure 13 made of fabric fitted onto it, presenting a concavity 14 in which to put a child in a half-seated, half-lying position. Two semi-rigid moderately well padded panels are fitted onto the concave seat; the first 15 of these creates a backrest, the second 16 forms the seat. Each of the two curved laminae 11, 12, is closed similar to a ring, the part in contact with the ground having a more accentuated curve than the upper part that supports the containing structure 13. The two laminae, 11 and 12, are each made of a metal lamina of constant thickness, cut to the desired length and curved as shown in the figure, the two ends being joined by welding. Compared with the rocker-cradle 1 in the preceding figure, the one just described not only rocks but can to some extent act as a shock-absorber for the stresses received from the dynamic load carried in the fabric structure, 13, 14. In the rocking types the effect of shock-absorption is complementary to that of balancing and therefore not so necessary as in the case of cradles with a base fixed to the ground. Flexion of the lateral laminae 11, 12, is limited by their being closed ring-wise, but is nevertheless sufficient for the purpose.

FIG. 3 shows a side view of a frame 20 for supporting a containing structure (not seen) made of fabric similar to that in the preceding figure though not the same. Like many cradles of this type, the frame 20 is symmetrical on the two sides. As will be seen, side of frame 20 shown in the figure comprises a lamina 21 bent in two places to form an upper part inclined upwards from the central bend, and a base that rests on the ground in two places at the two ends. The two ends of the upper part are joined to two crosswise laminae, 22 and 23, in turn joined to the other lateral lamina not shown in the figure. As the two type-21 lateral laminae are open, the containing structure of fabric can be shaped like a bag to be fitted over the frame 20. The lateral laminae are made from a metal lamina of constant thickness and of the desired width, cut to size and bent as shown in FIG. 3. The bending process is that normally used for bending metal sheet, for example by the use of a calendar with cylindrical rollers.

FIG. 4 shows the rounded type of curve given to the lateral lamina 21 between the upper part and that resting on the ground. The angle between the two segments that converge at the curve is about 28°. This value ensures a satisfactory position for the child, neither too flat nor raised too high, and an elastic return of the upper part to its former position after being deformed by compression. The frame shown in FIG. 3 also permits rocking by exploiting the elasticity of the lateral laminae, unlike the frame in the cradle in FIG. 2 which resorts to balancing. Although the frame in FIG. 3 is mainly satisfactory, it has some drawbacks due to the fact that the structure is almost completely flexible, both as regards supporting the weight of the child and for its rocking dynamics. Metals that exploit their elastic properties are well known to be subject to fatigue and, in time, constant wear may cause a breakage. Further, the latest models of cradles with a containing structure of fabric are more concave than the earlier ones and form a kind of bag the depth of which can be adjusted by means of a strap at the rear. If a containing structure of fabric were to be fitted onto the frame in FIG. 3, it might be too flexible and, if fully stretched, the bag might touch the ground which would certainly be inadvisable.

The drawbacks to the frame shown in FIG. 3 are evident in the type of use envisaged by the design, typically for these types of cradle, but may also be evident in similar frame structures based essentially on elasticity for supporting dynamic loads, namely in structures able to transfer spontaneous stresses. For example, similar drawbacks might arise if elastic laminae were used in the production of high chairs for small children, seats, armchairs, trolleys, etc.

U.S. Pat. No. 2,283,755 A discloses an article of furniture comprising supporting means, a seat member carried by said supporting means, said supporting means having a front leg merging at its upper and lower ends into rearwardly extending arms, the lower arm forming a ground-engaging base, said supporting means being formed of a continuous integral strip of material, and the cross-section of said strip taken in planes perpendicular to the longitudinal axis of said strip from a point of said lower arm to an upper point of said strip being varied in shape to give decreasing moments of resistance against bending stresses caused by a constant load on said seat member.

The article of furniture described in this citation provides a support which has a gradually increasing resilience from the ground engaging portion towards the seat engaging portion. To say, gradually increasing flexibility and gradually reducing rigidity, just the contrary of the technical problem the present invention is aimed at.

SUMMARY OF THE INVENTION

Purpose of the present invention is therefore to overcome the drawbacks inherent in frames made of flexible laminae, especially if used in cradles for small children, but not only in these items.

To achieve this purpose, subject of the present invention is

> a frame suitable for use in a cradle for small children, or in similar devices in which support must be given to a structure for containing a dynamic load, the frame comprising two longitudinal flexible laminae, parallel one to another and joined by at least one crosswise lamina, said longitudinal laminae being curved in at least one part of their length, to form a first section that rests on the ground, and a second section for supporting said containing structure, each longitudinal lamina being subjected to a torsion during a shaping process that produces a permanent deformation; in which, according to the invention, said second section being upwardly inclined;

at least in the curved part, each longitudinal lamina is subjected to either clockwise or anticlockwise torsion, and the radius of curvature at the side of the lamina in the direction of torsion is less than the radius of curvature at the opposite side, as described in claim 1.

Further characteristics of the present invention considered as innovative are described in the dependent claims.

Before describing any further aspects of the invention, consideration must be given to the fact that, on account of the torsion, one side of one lamina will be translated in relation to the other side and, from being initially flat and undistorted, the lamina will then be inclined in the direction of the torsion. This means that, along the curved part, the radius of curvature at one side of the lamina will differ from the radius of curvature at the other side of the same lamina or, more precisely, the radius of curvature at the side of the lamina in the direction of torsion will be less than the radius of curvature at the opposite side.

In one realized form said torsion continues in the same direction from the curved part as far as the end of the second section of the longitudinal laminae.

In another realized form said torsion continues in the same direction along the first section of the longitudinal laminae as well.

In another realized form the two laminae are subjected to torsions opposite in sign such as to incline them towards the inside of the frame. In another realized form the two laminae are subjected to torsions opposite in sign such as to incline them towards the outside of the frame.

In another realized form the two longitudinal curved laminae are subjected to torsions in the same direction such as to incline one lamina towards the inside of the frame and the other lamina towards the outside of the frame.

In another realized form the two longitudinal curved laminae are joined by a further crosswise lamina, the crosswise laminae being joined to the two ends of the second section of the longitudinal laminae.

In another realized form the two longitudinal curved laminae are joined by a further crosswise lamina joined to the end of said first section farthest from the curved part.

In another realized form the first section of the two curved laminae resting on the ground includes a crosswise bend preferably located farther from the curved part in relation to the distance from the opposite end, and the two segments converging at the curve are inclined towards the second section, consequently reducing the angle initially determined between the first and second section by the value of said inclination.

ADVANTAGES OF THE INVENTION

Several prototypes of the cradles, comprising the frame realized according to the present invention, have been subjected to rigorous experimental tests the results in each case having been more than satisfactory. This means that the type of deformation impressed on the two longitudinal laminae along their curved parts does in fact solve the technical problems noted in previous models of cradles. On account of the torsion, flexibility of the longitudinal laminae in particular is sufficiently reduced to lessen the excessively elongated oscillations that tend to lower the containing structure too far when adjusted for maximum capacity. Lamina fatigue caused by continuous stresses from the dynamic load was found to have been reduced, so also lessening the risks connected with loss of elasticity and breakage.

It will be appreciated that these advantages require measures at practically no extra cost as curving can be executed using a cylindrical-roller calander and a hydraulic press with a conical mould and specially made dolly.

SHORT DESCRIPTION OF THE FIGURES

Further advantages offered by the present invention will be made clear by the following detailed description of an example of its realization and by the attached drawings given purely for explanatory purposes and in no way limitative, wherein.

DETAILED DESCRIPTION OF SOME PREFERRED REALIZATIONS OF THE INVENTION

In the following description the same elements that appear in different figures may be marked with the same symbols. When describing a figure, reference may be made to elements not expressly shown in that figure but in previous ones. The scale and proportions of the various elements shown do not necessarily correspond to reality.

Figure 1:
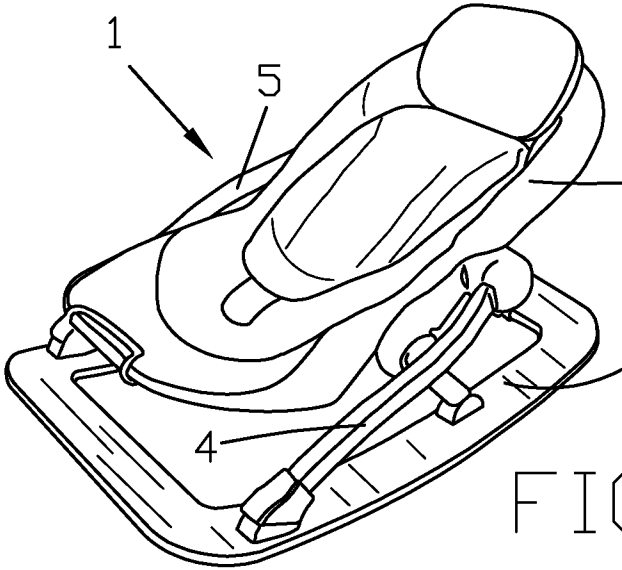
FIG. 1 shows a view in perspective of a first cradle (rocking type) realized according to the known art.
Figure 2:
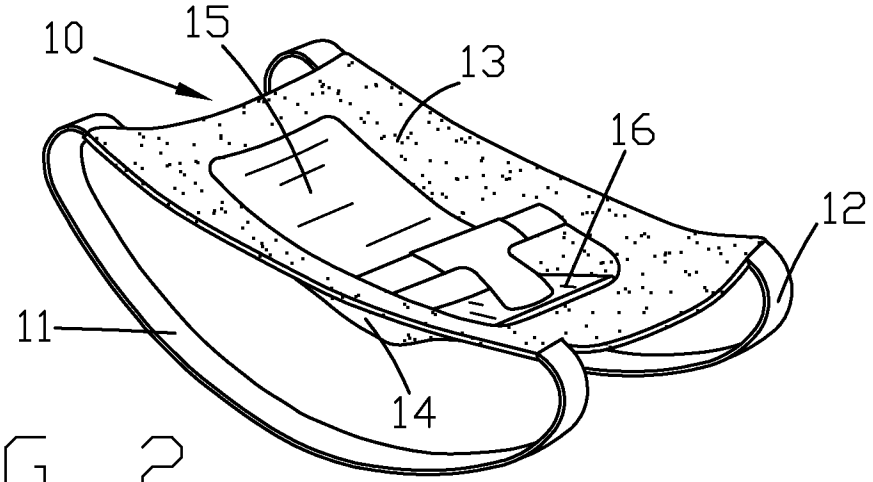
FIG. 2 shows a view in perspective of a second cradle (rocking type) realized according to the known art using flexible laminae closed in the form of a ring.
Figure 3:
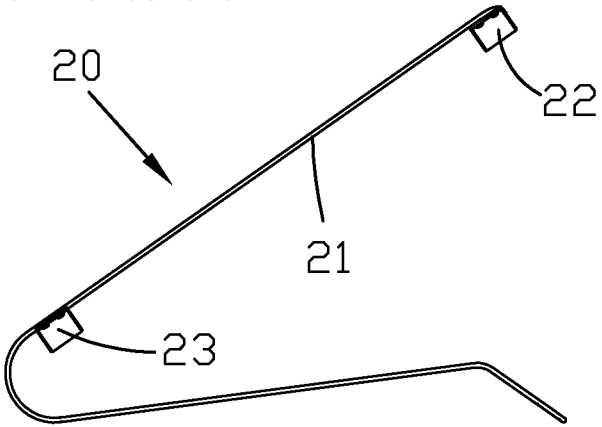
FIG. 3 shows a side view of a third cradle realized according to the known art using flexible laminae in an open configuration.
Figure 4:
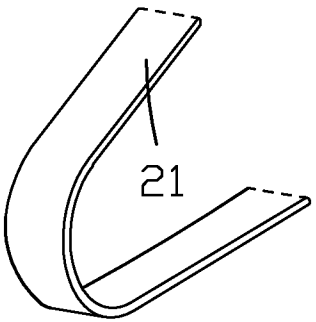
FIG. 4 shows a view in perspective of the curved part of the flexible lamina in FIG. 3.
Figure 5:
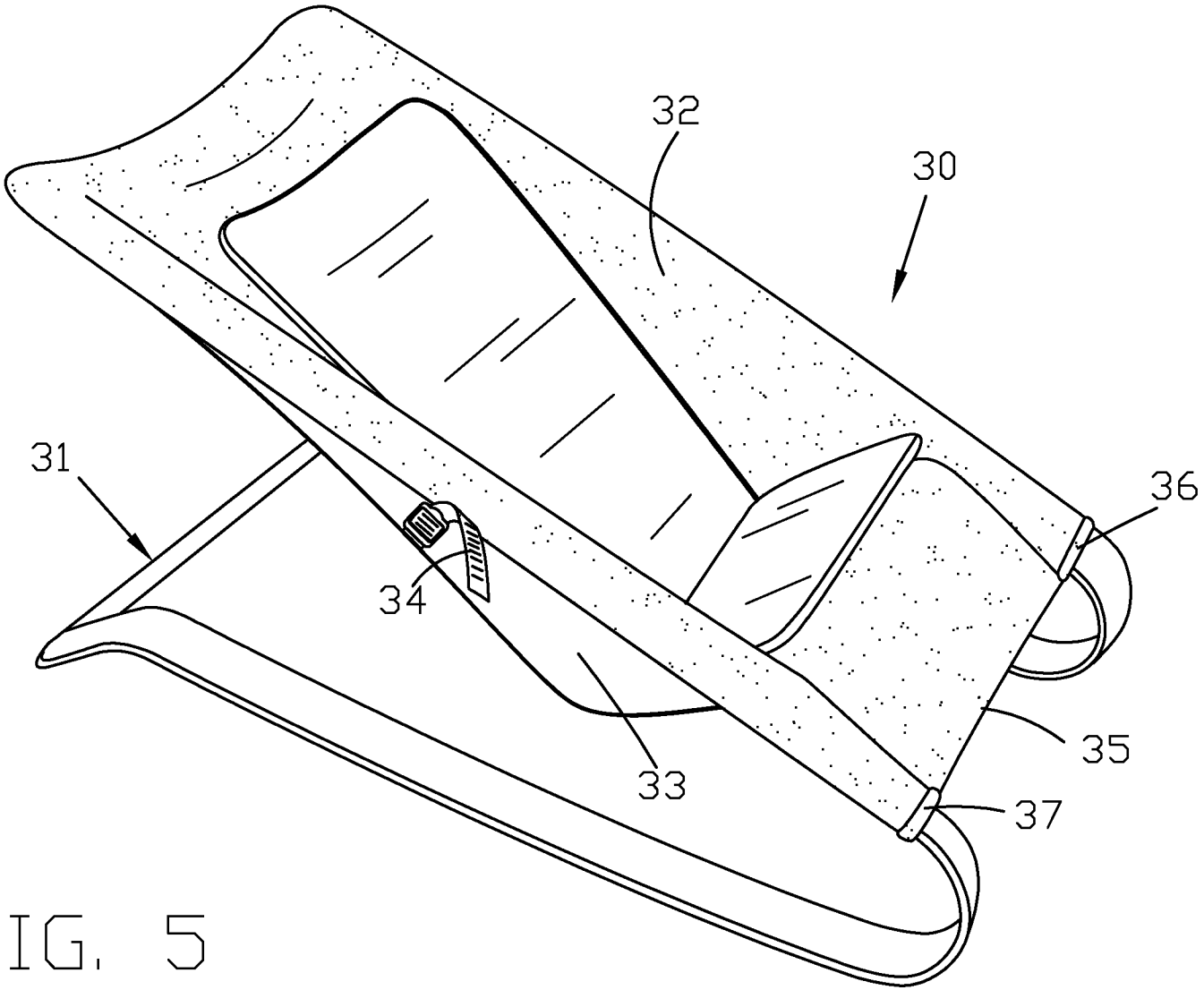
FIG. 5 shows a view in perspective of a cradle that includes the frame made according to the present invention.

FIG. 5 shows a view in perspective of a cradle 30 consisting of a frame 31 resting on the ground and inclined upward over which a containing structure 32 made of fabric (not subject of the present invention) is fitted, so making it suitable for accommodating a small child. The frame 31, subject of the invention, will be described in detail in the description of the next figure. It may be noted here that, in the containing structure 32, there is a concavity accessible from the front and extending downward and rearward like a bag much more capacious than the bag on the rocking cradle seen in FIG. 2. The capacity of bag 33 can be adjusted by a strap 34 lying crosswise underneath it. Tightening the buckle on the strap 34 gives a vertical position to the backrest. The special structure of the frame 31 with its flexible laminae is the characteristic that makes it lie flat and, as such, suitable to be fitted with a pliable containing structure which, by its very nature, can simultaneously offer both mechanical resistance and pliability without any need for heavy padding. The figure shows a lip 35 at the opening of the bag structure 32 between the hems 36 and 37. The lip 35 extends underneath a crosspiece of the frame 31 and is fixed by a strip of Velcro on the underside of the bag.

Figure 6:
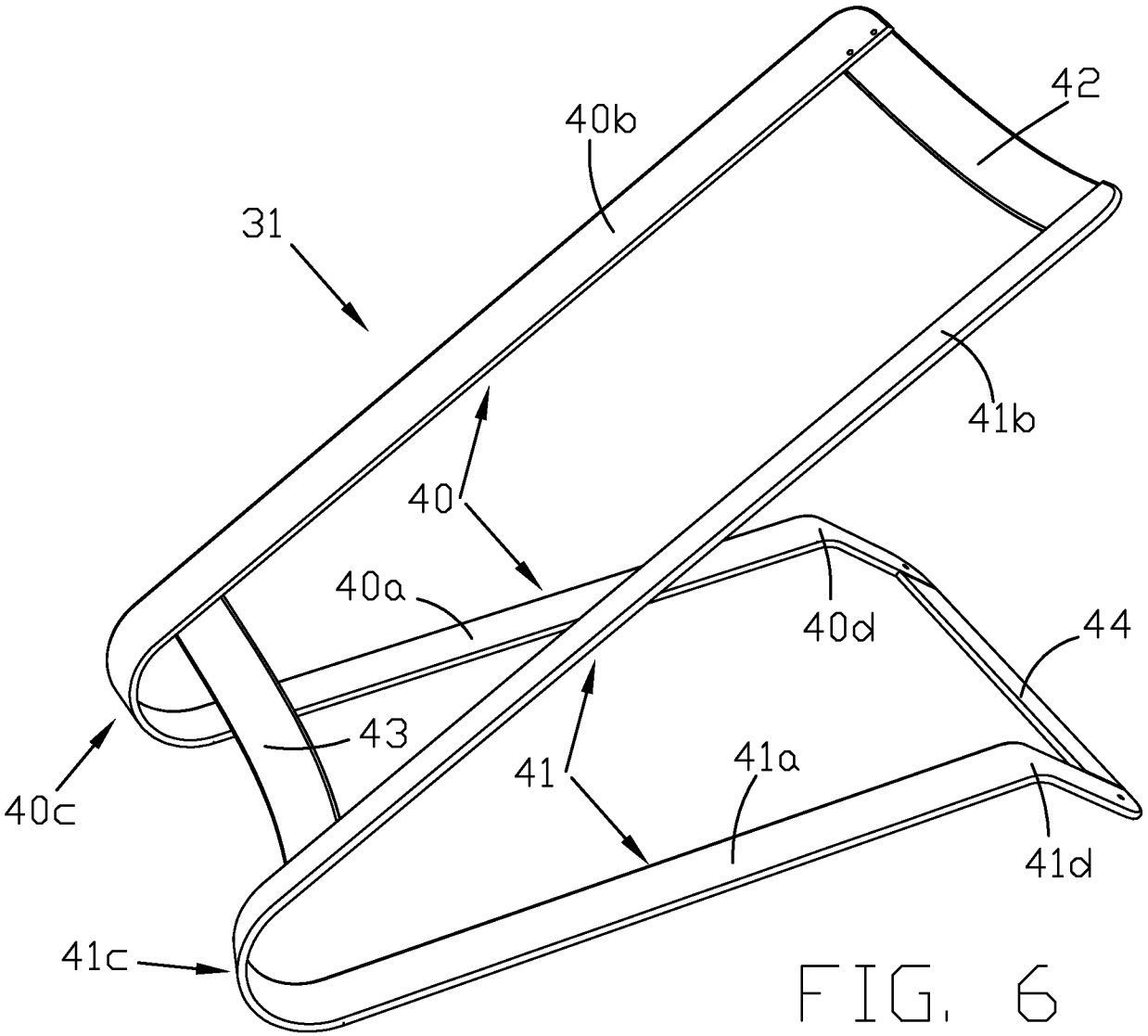
FIG. 6 shows a view in perspective of the frame made according to the present invention.

FIG. 6 gives a perspective view of the bare frame 31 showing that it consists of two parallel longitudinal laminae 40, 41, suitably curved in a substantially central position, respectively 40*c* and 41*c*; in this way a lower section of each lamina, respectively 40*a* and 41*a*, is formed to rest on the ground, and an upwardly inclined upper section, respectively 40*b* and 41*b*. The form and dimensions of the curved parts, 40*c* and 41 *c*, coincide in the two laminae 40 and 41, as also does the distance between the centre of said parts and the ends of the respective laminae. The upper inclined sections, 40*b* and 41*b*, are joined by two crosswise laminae, 42 and 43, like slightly concave staves, joined to both sections at their ends. The lower sections, 40*a* and 41*a*, are joined by a crosswise lamina 43 to both sections at their ends farthest from the curved part. The lower sections, 40*a* and 41*a*, are joined by a crosswise lamina 43 to both sections at the end farthest from the curved part. The lower sections, 40*a* and 41*a*, present a bend, 40*d* and 41*d* respectively, close to their ends farthest from the curved part. The effect of these bends is that the two converging segments are both upwardly inclined. Frame 31 therefore touches the ground at the external side of the crosswise lamina 44 and at the tangential surfaces between the ground and the curved parts 40*c* and 41*c*. This configuration of the lower sections 40*a* and 41*a* is obviously not binding and these parts can rest flat on the floor without being inclined. Looking carefully at the perspective views of curved parts 40*c* and 41*c*, it will be seen that the radius of curvature of the lateral profiles of laminae 40 and 41, facing towards the inside of the frame, is less than the radius of curvature of the corresponding profiles of the external sides. There is no difference in curvature in the lower sections, 40*a* and 41*a*, though this difference is present in the upper sections 40*b* and 41*b* in continuation with curved parts 40*c* and 41*c*. This presence simplifies the curving process and ensures that upper sections 40*b* and 41*b* face towards the inside of the frame for better adaptation to the concavity of the containing structure 32 (FIG. 5) that will be applied to it.

Figure 7:
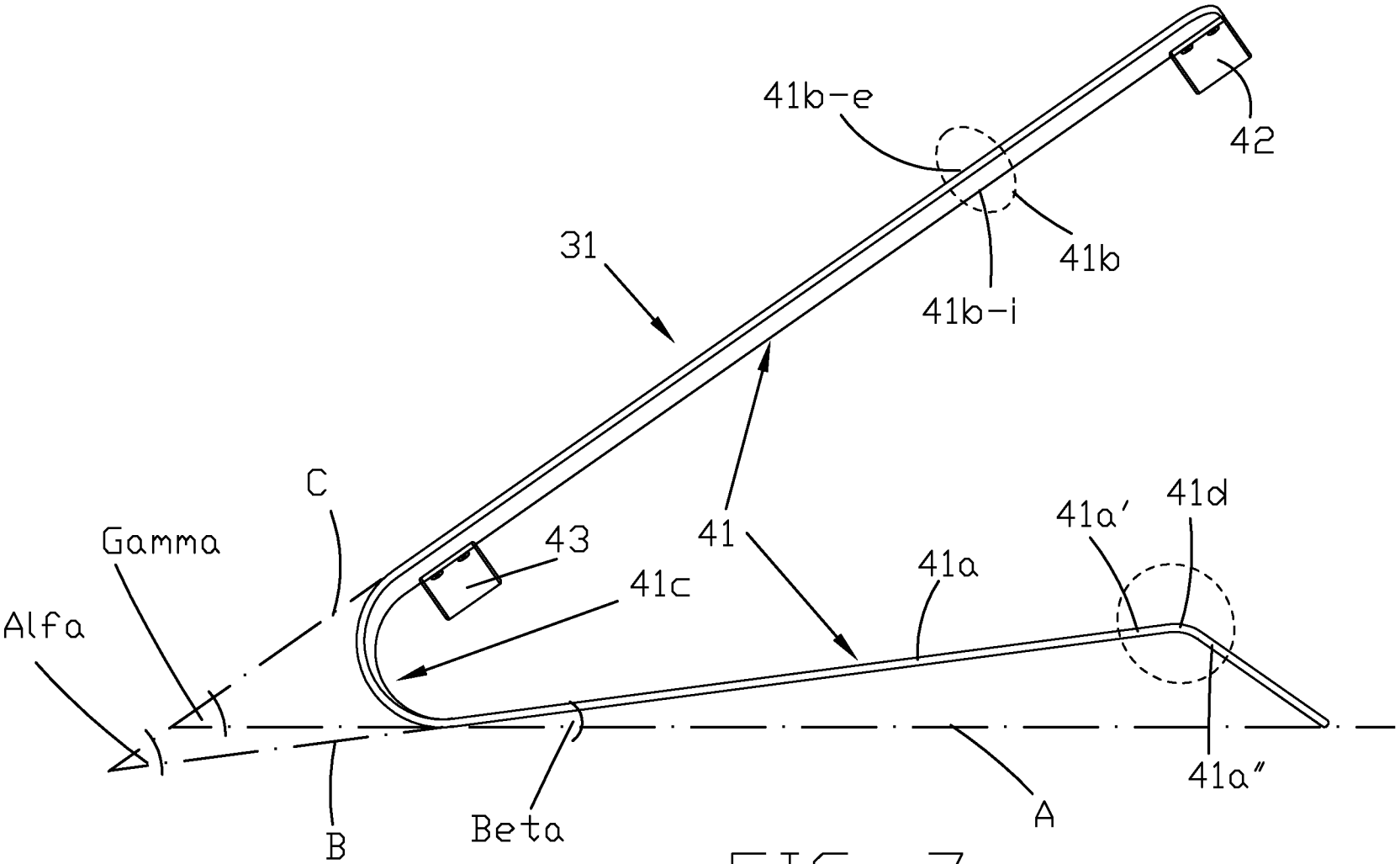
FIG. 7 shows a side view of the frame in FIG. 6.

FIG. 7 is a right-hand lateral view of frame 31, conventionally considering the right-hand side to be that opposite to the right hand looking at the frame from the front. This view clearly shows that there is a differential curve 41*c* on the right-hand lamina 41 between the profiles of the two sides, created by a torsion towards the right, the effect of which is to lower the profile of the inner side 41*b-i* in relation to the profile of the outer side 41*b-e*. As from the end of the curve, misalignment between the profiles of the two sides continues along the whole rectilinear section 41*b* which means that the rectilinear section has also been subjected to torsion but not to flexion. The same reasoning applies to lamina 40 subjected to left-hand torsion so that it too is inclined towards the inside of the frame. In the lower part of the frame 31 the rectilinear section 41*a* shows no deformation that could be caused by torsion.

Towards the end of section 41*a*, a bend 41*d* delimits two segments 41*a*' and 41*a*", both upwardly inclined starting from the ends distant from the bend 41*d*. The purpose of a bend such as this is to increase the rigidity of frame 31 to a certain extent, at the same time reducing elongation of the flexor oscillations, but reducing the surface for resting the frame on the ground. The figure shows three axes indicated by the letters A, B and C. Axis A represents the horizontal line of the floor; axis B is aligned to the lower inclined section 41*a*; axis C is aligned to the upper inclined axis 41*b*. Angle Alpha is formed between axes B and C, angle Beta between axes A and B and angle Gamma between axes A and C. Angle Gamma is clearly the sum of angles Alpha and Beta which means that, in relation to a configuration in which the lower section 41*a* is horizontal and rests entirely on the floor, angle Alpha, between sections 41*a* and 41*b* of the same lamina 41, is reduced by angle Beta. In practice it is as if the frame had been preloaded with a weight sufficient to reduce angle Alpha by angle Beta thus reducing elongation of the flexor oscillations.

Figure 8:
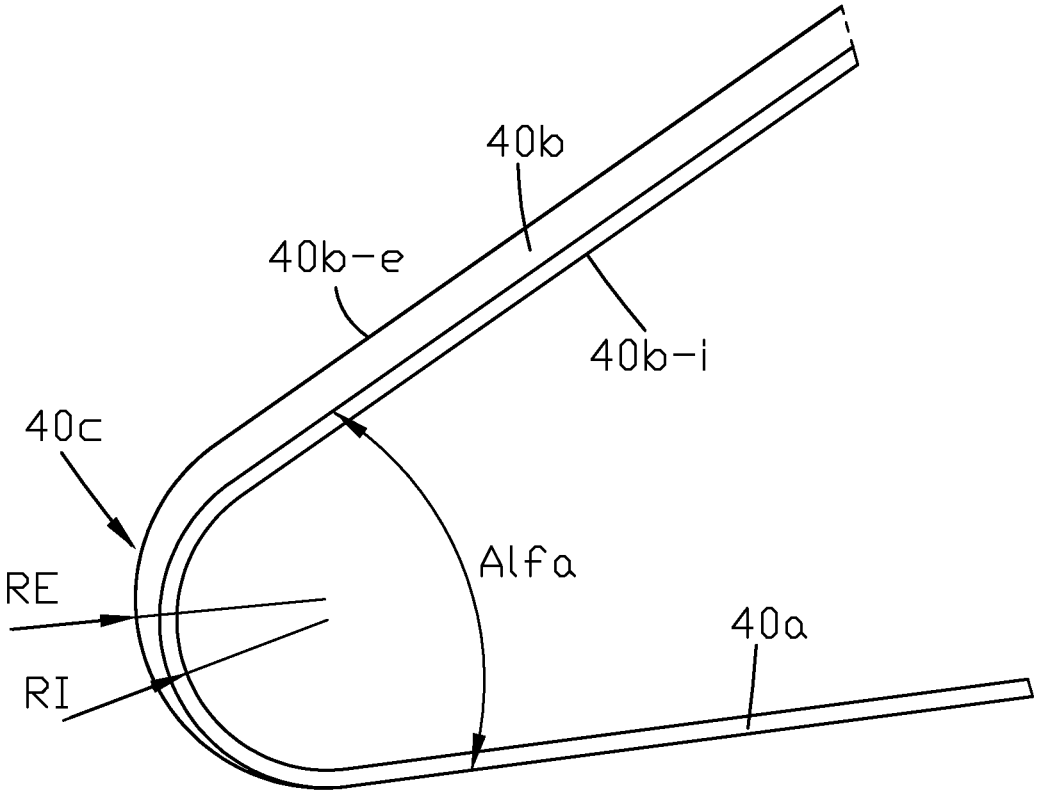
FIG. 8 shows a view in perspective of the curved part of a flexible lamina in FIG. 6.

FIG. 8 shows a view in perspective of the curved part of the left-hand lamina 40 in FIG. 6. It will be seen from the figure that, due to geometrical distortion caused by leftward torsion, lamina 40 is inclined crosswise towards the inside of the frame creating misalignment between the centres of the curved profiles of the external side 40*b-e* and of the internal side 40*b-i*. In one example realized, the respective radii of curvature RE and RI assume the following values: RE=64.6 mm; RI=57.4 mm while the Alpha angle is of 27.5°. The figure also shows that the lower section 40*a* is not crosswise inclined.

Figure 9:
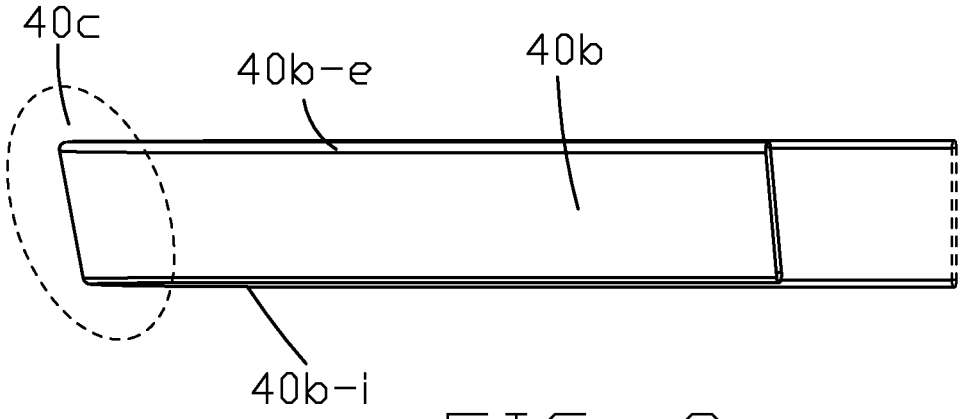
FIG. 9 shows a view from above of the curved part in FIG. 8.
Figure 10:
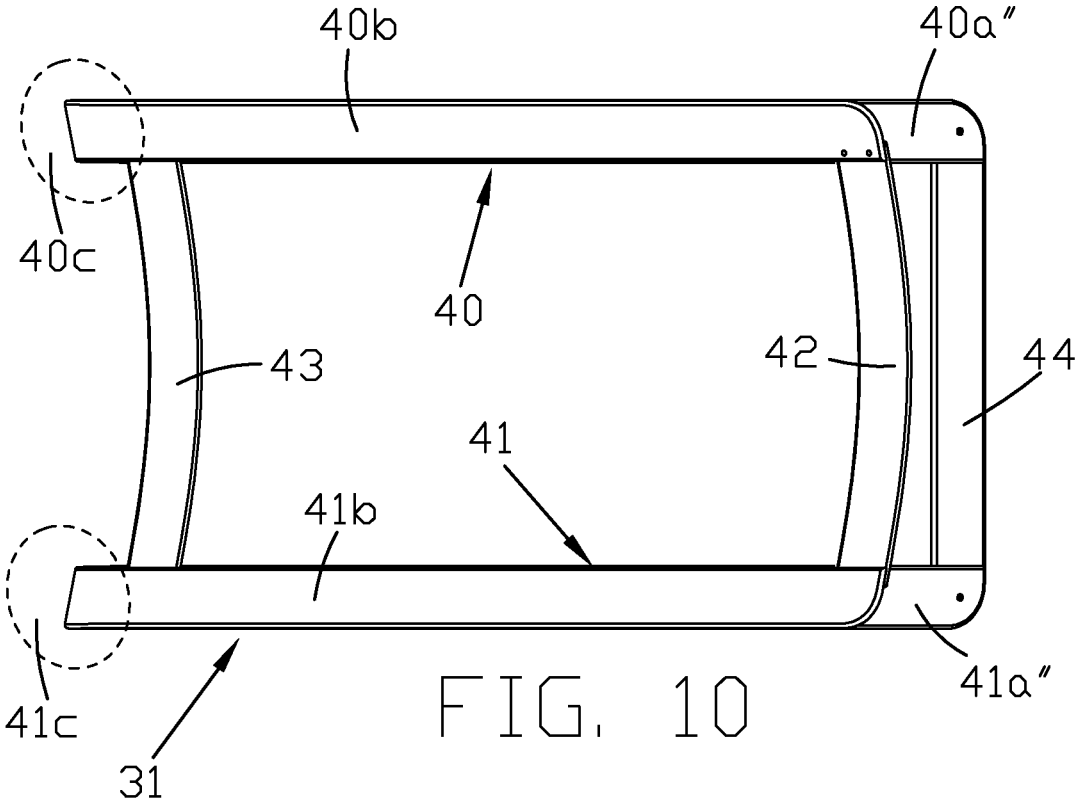
FIG. 10 shows a view from above of the frame in FIG. 6.
Figure 11:
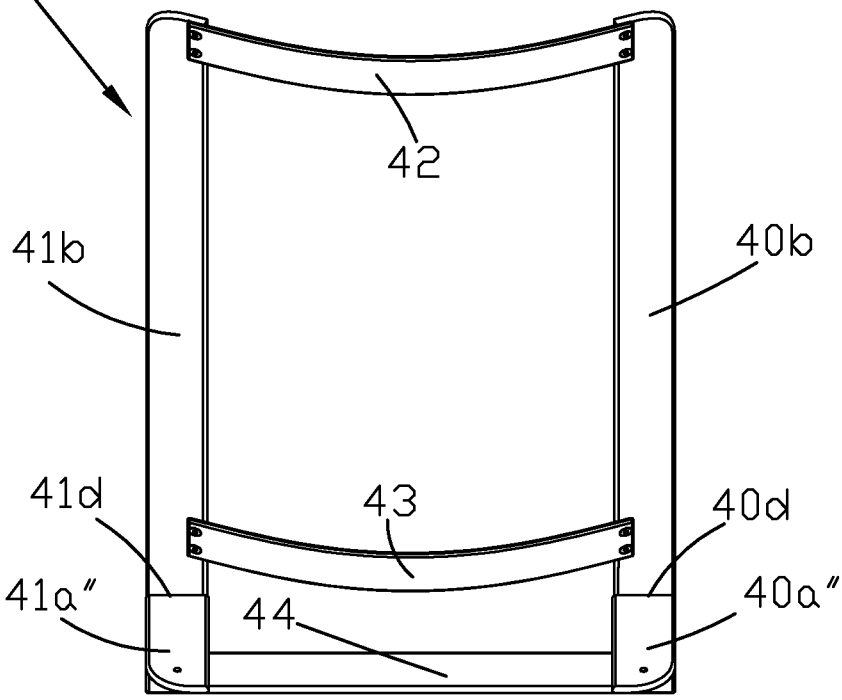
FIG. 11 shows a view of the rear of the frame in FIG. 6.

The view from above in FIG. 9 of the curved part shown in FIG. 8, emphasises the degree of inclination of section 40*b* towards the inside of the frame at the curved part 40*c*. FIG. 10 shows a view from above of the frame 31 that includes the detail in FIG. 9 in a more complete context. The figure shows how both sections 40*b* and 41*b* converge towards the inside of the frame in their respective curved parts 40*c* and 41*c*. The frame 31 extends at the position of the lower crosswise lamina 44, beyond the upper crosswise lamina 42. Lamina 44 is straight while laminae 42 and 43 are slightly curved. FIG. 11 is a rear view of the frame 31 clearly showing how the crosswise laminae 42, 43 and 44 are fixed to the longitudinal laminae 40, 41 by a pair of screws at each end.

Figure 13:
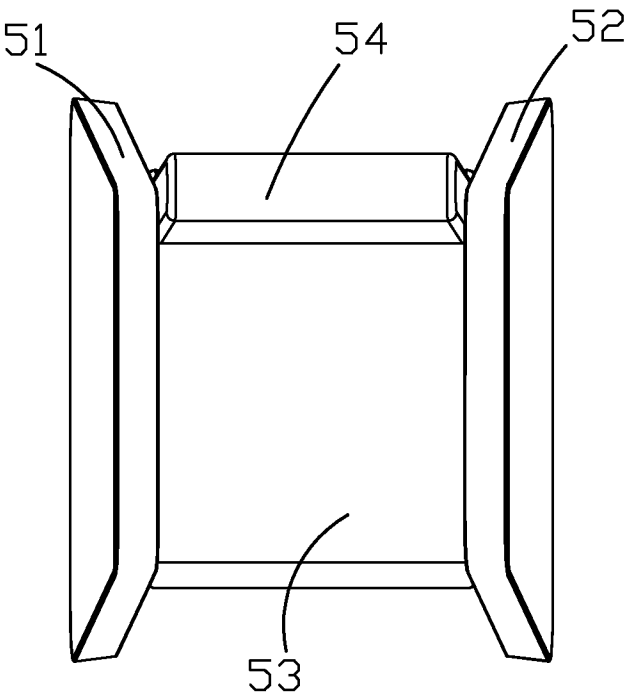
FIG. 13 shows a view from above of the high chair in FIG. 12.
Figure 12:
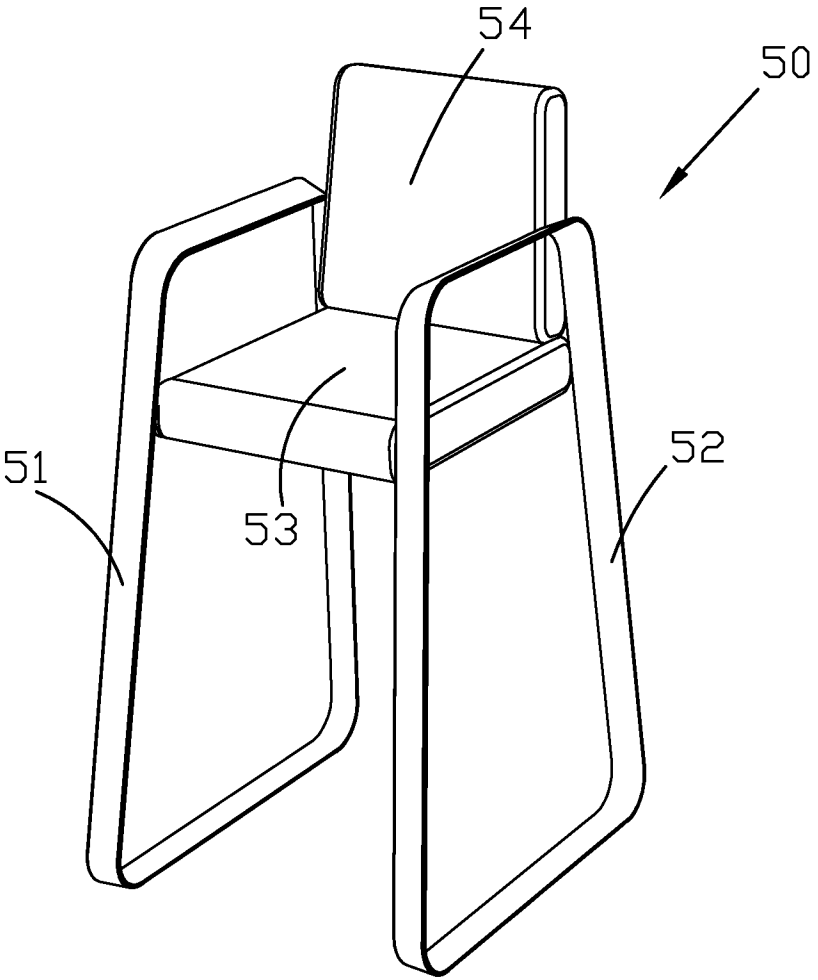
FIG. 12 shows a view in perspective of a high chair for children made according to the principles of the present invention.

FIG. 12 gives a perspective view of a child's highchair 50 in a simplified version to show a frame formed of two laminae 51, 52 closed ring-wise to create two lateral resting structures, joined by two crosswise lamine (not seen) that support a seat 53 complete with backrest 54, both padded. In this closed configuration, laminae 52 and 53 take on the form of isosceles trapezes of a height preponderant in relation to the bases on which they stand. The laminae are curved at the four corners and transversally inclined towards the seat 50 for the whole of their length, as appears in FIG. 13, where it will be seen that the two trapezes formed by the laminae 52, 53, closed ring-wise, converge upwards and are slightly inclined to increase stability of the bearing. This convergence of the frame is combined with inclination inwards of the two flat bases produced by torsion. On account of their flexibility, the use of metal laminae in the supporting structure of a seat to form a highchair presents similar problems, though of lesser importance than those noted in the case of the cradle, and the measures taken to solve them are the same.

Based on the description given of a preferred example of realization of the invention, a person expert in the field can obviously make some changes without thereby departing from its sphere of application, as will be seen by the following claims. The frame of flexible laminae here invented can in fact be used in fields other than that of accessories for children, such as in industry where the loads to be carried are far heavier than the weight of a child.

The invention claimed is:

1. Frame suitable for use in a child's cradle (30) or in similar devices (50) wherein a structure (32, 33) for containing a dynamic load requires support, the frame (31) comprising two flexible longitudinal laminae (40, 41), parallel one to another and joined by at least one crosswise lamina (43), said longitudinal laminae being curved at least in one part (40*c*, 41*c*) of their length to form a first section (40*a*, 41*a*) resting on the ground, and a second section (40*b*, 41*b*) for supporting said containing structure, each longitudinal lamina (40, 41) being subjected to a torsion during a shaping process that produces a permanent deformation;

characterized in that:

said second section (40*b*, 41*b*) being upwardly inclined;

at least in the curved part (40*c*, 41*c*), each longitudinal lamina (40, 41) is subjected to either clockwise or anti-clockwise torsion and the radius of curvature at the side of the lamina in the direction of torsion is less than the radius of curvature at the opposite side.

2. Frame as in claim 1, characterized in that said second section (40*b*, 41*b*) of the longitudinal laminae is also subjected to torsion in the same direction as that to which the curved part (40*c*, 41*c*) is subjected.

3. Frame as in claim 1, characterized in that said first section (40*a*, 41*a*) of the longitudinal laminae is also subjected to torsion in the same direction as that to which the curved part (40*c*, 41*c*) is subjected.

4. Frame as in claim 1, characterized in that the two longitudinal laminae (40, 41) are subjected to torsions opposite in sign such as to incline them towards the inside of the frame (31).

5. Frame as in claim 1, characterized in that the two longitudinal laminae (40, 41) are subjected to torsions opposite in sign such as to incline them towards the outside of the frame (31).

6. Frame as in claim 1, characterized in that the two longitudinal laminae (40, 41) are subjected to torsions in the same direction such as inclines one lamina towards the inside and the other lamina towards the outside of the frame (31).

7. Frame as in claim 1, characterized in that it includes a further crosswise lamina (42), the two crosswise laminae (42, 43) being connected to the two ends of the second section (40*b*, 41*b*) of the two longitudinal laminae.

8. Frame as in claim 1, characterized in that it includes a further crosswise lamina (44) connected to the end of the first section (40*a*, 41*a*) of the two longitudinal laminae farther than the other end from the curvature (40*c*, 41*c*).

9. Frame as in claim 1, characterized in that it includes:

a second crosswise lamina (42), the two crosswise laminae (42, 43) being connected to the two ends of the second section (40*b*, 41*b*) of the two longitudinal laminae;

a third crosswise lamina (44) connected to the end of the first section (40*a*, 41*a*) of the two longitudinal laminae farther than the other end from the curvature (40*c*, 41*c*).

10. Frame as in claim 1, characterized in that said first section (40*a*, 41*a*) of the two longitudinal laminae comprises a crosswise bend (40*d*, 41*d*) at a distance, from the curvature (40*c*, 41*c*) greater than the distance from the curvature of the opposite end of the same section, the two segments converging in the bend being inclined towards the respective second section (40*b*, 41*b*) of the two longitudinal laminae.

* * * * *